US006687952B1

(12) United States Patent
Mohan, Jr.

(10) Patent No.: US 6,687,952 B1
(45) Date of Patent: Feb. 10, 2004

(54) WET VACUUM CLEANER ATTACHMENT FOR VACUUM CLEANERS

(75) Inventor: Traian Mohan, Jr., North Royalton, OH (US)

(73) Assignee: HMI Industries, Inc., Seven Hills, OH (US)

( * ) Notice: Subject to any disclaimer, the term of this patent is extended or adjusted under 35 U.S.C. 154(b) by 166 days.

(21) Appl. No.: 10/037,856

(22) Filed: Jan. 7, 2002

(51) Int. Cl.[7] ..... A47L 9/02

(52) U.S. Cl. ..... 15/353; 15/415.1; 15/419; 15/420

(58) Field of Search ..... 15/353, 415.1, 15/419, 420; 55/DIG. 3

(56) References Cited

U.S. PATENT DOCUMENTS

| | | | | |
|---|---|---|---|---|
| 1,654,652 A | | 1/1928 | Jordanoff | |
| 1,654,653 A | | 1/1928 | Jordanoff | |
| 1,773,051 A | | 8/1930 | Marenti | |
| 1,942,358 A | | 1/1934 | Grathwol | |
| 2,033,833 A | | 3/1936 | Kent | |
| 2,763,886 A | | 9/1956 | Brown, Jr. et al. | |
| 3,134,128 A | * | 5/1964 | Campbell | 15/420 |
| 3,946,458 A | | 3/1976 | Creamer et al. | |
| 4,675,936 A | * | 6/1987 | Rawlins | 15/353 |
| 4,887,330 A | | 12/1989 | Woodhall et al. | |
| 5,248,323 A | | 9/1993 | Stevenson | |
| 5,263,224 A | * | 11/1993 | Lovelady | 15/353 |
| 5,377,383 A | * | 1/1995 | Christensen | 15/353 |
| 5,454,139 A | | 10/1995 | Beck | |
| 5,634,238 A | * | 6/1997 | McCaffrey et al. | 15/353 |
| 5,974,624 A | * | 11/1999 | Eisen | 15/353 |
| 6,003,196 A | | 12/1999 | Wright et al. | |
| 6,243,915 B1 | | 6/2001 | Nakai et al. | |

* cited by examiner

*Primary Examiner*—Theresa T. Snider
(74) *Attorney, Agent, or Firm*—Fay, Sharpe, Fagan, Minnich & McKee

(57) ABSTRACT

A vacuum cleaner attachment which can be connected to a dry vacuum cleaner to convert the dry vacuum cleaner into a wet vacuum cleaner such that a liquid can be removed from a surface. The vacuum cleaner has a vacuum source for drawing an air stream through an inlet and exhausting the air stream through an outlet. The attachment comprises a housing including a passageway having a first end and a second end in fluid connection with the first end, and a coupler on the first end for coupling the first end with either the inlet or the outlet of the vacuum cleaner so that the air stream produced by the vacuum source passes through the passageway. The housing also includes a reservoir and an intake nozzle. The passageway has a restricted passage portion between the first and second ends including an opening in fluid connection with the reservoir such that when the air stream passes through the passageway, the restricted passage portion produces a vacuum in the reservoir thereby drawing the liquid from the surface through the intake nozzle and into the reservoir.

29 Claims, 6 Drawing Sheets

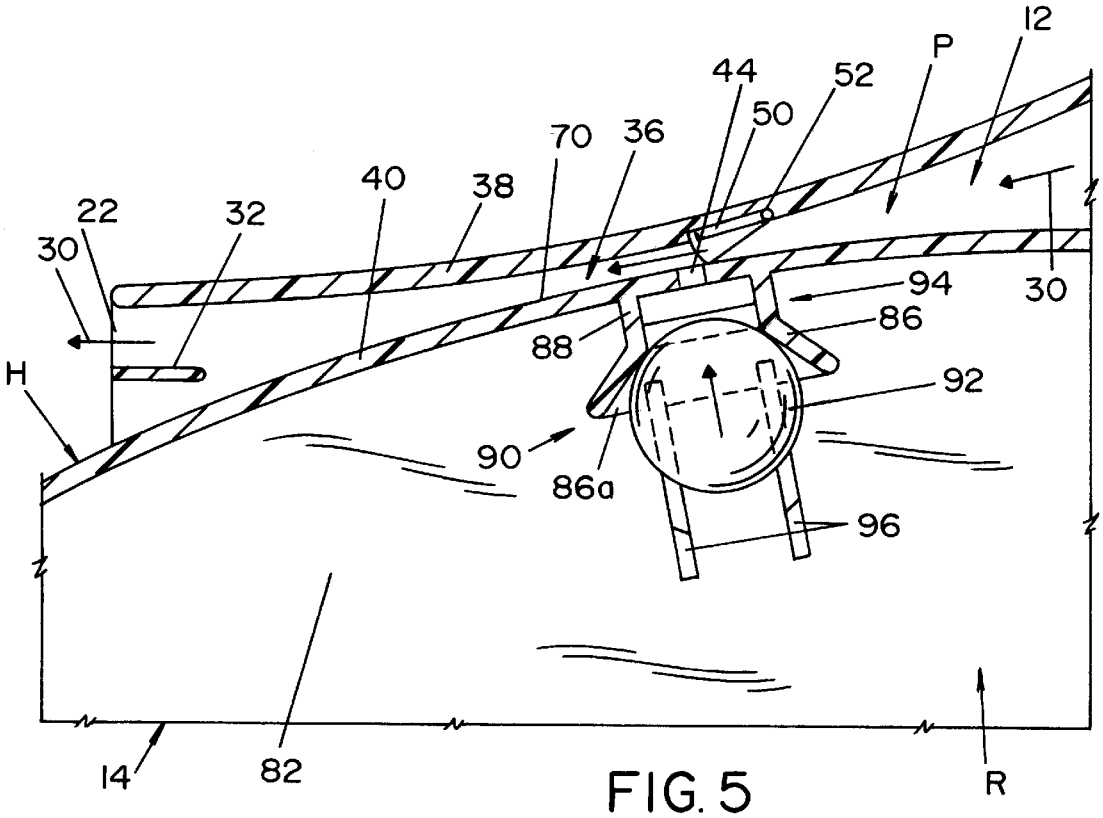
FIG. 5
FIG. 7
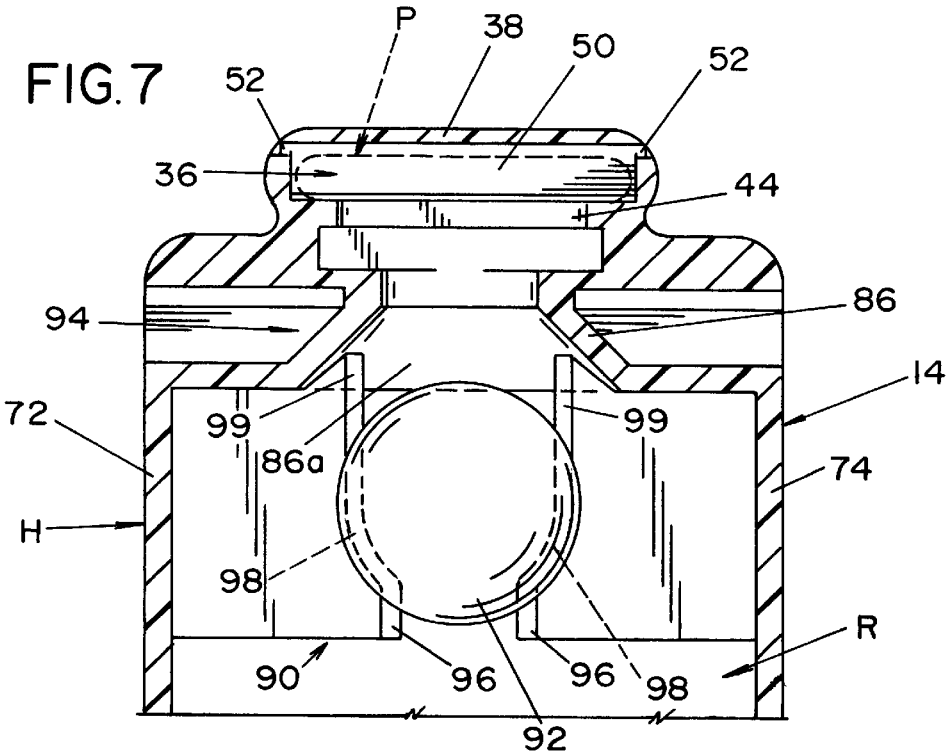

WET VACUUM CLEANER ATTACHMENT FOR VACUUM CLEANERS

This invention relates to the art of vacuum cleaners, and more particularly to a vacuum cleaner attachment for converting a dry vacuum cleaner into a wet vacuum cleaner for picking up liquid off a surface.

INCORPORATION BY REFERENCE

The present invention relates to converting a traditional dry vacuum cleaner into a wet vacuum cleaner. Dry vacuum cleaners are known in the art and are generally shown in Nakai 6,243,915; and Wright 6,003,196. Nakai discloses a dry vacuum cleaner which utilizes a bag type retention area and is incorporated by reference herein as background information. Wright teaches the use of cyclonic action to separate the particles from the air in a fluid stream. Wright is also incorporated by reference as background information.

BACKGROUND OF THE INVENTION

It is, of course, well known that a vacuum source can be used to remove either particles or liquids from a surface and deposit the same in a designated location. In this respect, an electric motor typically drives an impeller which creates a vacuum that is then directed to the surface, wherein the liquid and/or particles are drawn away from the surface in a fluid stream toward the vacuum source. Eventually, the fluid stream is directed into a designated retention area that is designed to separate the particles and/or liquids from any air in the fluid stream. The air is then allowed to escape through a designated exhaust opening. In order to retain the particles, some form of filter arrangement is utilized which is positioned in the fluid stream either before or after the vacuum source. No matter whether the vacuum source is before or after the filter arrangement of the retention area, the motor must be protected from the particles and/or liquids traveling in the fluid stream to prevent damage. Further, the air in the fluid stream is typically utilized to cool the motor. The way in which the motor and the impeller of the vacuum source are protected from damage is dependent on whether the vacuum system is designed to remove particles or liquid from a surface and the position of the vacuum source in the fluid stream.

Not all vacuum systems are suitable for removing both particles and liquids from a surface due to the differences in separating liquids from air and separating particles form air. With respect to removing particles from a surface, the fluid stream consist mostly of air and the particles to be removed. The retention area is often a fiber based system which separates the particles from the air in the fluid stream by preventing the particles from passing through the fibers while allowing the air to freely pass through to an exhaust opening. In many cases, the fiber material is a porous bag which allows the air to escape while retaining a majority of the particles in a conveniently disposable retention area. Another type of particle retention area utilizes cyclonic airflow to separate the particles from the air in the fluid stream. Wright discloses the use of cyclonic separation. While these methods are effective in removing particles from an air stream, moisture in the air stream can have adverse effects on all portions of the vacuum system. In this respect, entry of moisture into the bag can cause mold to form, which can then be released into the surrounding air during subsequent uses. Further, the moisture can cause clumping or clogging of the pores in the bag, reducing the effectiveness of the particle removal and putting undue strain on the motor of the vacuum source. Further, moisture in the bag can eventually leak into the housing of the vacuum cleaner since the bag is not designed to retain moisture. With respect to cyclonic separation, moisture can reduce the cyclonic action and can produce mold and/or clog the exhaust opening. Another problem relates to the housing and motor of the vacuum cleaner. As stated above, the air from the fluid stream is typically used to cool the motor and therefore moisture in the fluid stream should be minimized. With respect to the housing and other structural components, metal is often used for many components within the vacuum cleaner which can rust if liquids are introduced into the fluid stream.

As a result, most vacuum cleaners are either designed for removing liquids from a surface or removing particles from a surface. Even if a vacuum is designed to remove both particles and liquids, the retention area must be cleaned immediately after the vacuum cleaner is used to prevent the particles and liquids from comingling and forming a hard solid residue which is difficult to remove or which can produce molds or other bacteria Further, the vacuum source must be designed to handle both moisture and particles in the fluid stream. This usually involves moisture protection for the motor and at least some form of particle filter to protect the motor and impellers from the particles in the fluid stream.

SUMMARY OF THE INVENTION

In accordance with the present invention, an attachment for a vacuum cleaner is provided which advantageously enables a vacuum cleaner designed to pick up dry particles to be converted into a wet vacuum cleaner which can pick up liquids and retain the same without interfering with the retention of the dry particles or adversely affecting the vacuum source. More particularly, the vacuum cleaner attachment according to the present invention can be easily connected to a vacuum source of a dry vacuum cleaner and utilize the vacuum source of the vacuum cleaner to remove liquid from a surface with out introducing the liquid into the primary air stream within of the dry vacuum cleaner.

The foregoing is achieved by utilizing the air stream of the vacuum cleaner to produce a second, independent vacuum source. Preferably, the exhaust of the primary air stream, which has already passed the motor and the particle retention area, is used to produce the secondary, independent vacuum source which draws the liquid from the surface into a reservoir separate from the particle retention area of the vacuum cleaner. If the attachment is connected to the exhaust opening, moisture cannot enter the primary air stream within the vacuum cleaner and therefore cannot affect the motor or the particle retention area of the vacuum cleaner. If the attachment is connected to the intake, the amount of moisture entering the primary air stream is significantly reduced. In addition, by utilizing a separate reservoir for the liquid picked up from the surface, the liquid can be maintained in a reservoir designed for liquid retention which can be easily drained after use.

It is accordingly an outstanding object of the present invention to provide a vacuum cleaner attachment for converting a dry vacuum cleaner into a wet vacuum cleaner which utilizes the air stream of a vacuum source of a dry vacuum cleaner to produce a secondary vacuum source which removes the liquids from the surface without moisture entering into the primary air stream within the vacuum cleaner.

Another object is the provision of a vacuum cleaner attachment according to the present invention that can be easily and quickly attached to a dry vacuum cleaner.

A further object of the present invention is the provision of a vacuum cleaner attachment of the foregoing character which retains the liquid in a retention area separate from the retention area for the dry particles.

Still another object of the present invention is the provision of a vacuum cleaner attachment of the foregoing character which requires only a minimal number of moving parts.

Yet another object of the present invention is the provision of a vacuum cleaner attachment of the foregoing character which is compact and light weight for easy use thereof.

Still a further object of the present invention is the provision of a vacuum cleaner attachment of the foregoing character which is cost effective to manufacture.

BRIEF DESCRIPTION OF THE DRAWINGS

The foregoing objects, and others, will in part be obvious and in part be pointed out more fully hereinafter in connection with the written description of a preferred embodiment of the invention illustrated in the accompanying drawings in which:

FIG. 5 is an enlarged partial sectional view of the ball valve component in FIG. 2 and showing the vacuum cleaner attachment is on its side;

FIG. 7 is a sectional elevation view of the ball valve taken along line 7—7 in FIG. 6;

DESCRIPTION OF THE PREFERRED EMBODIMENTS

Figure 1:
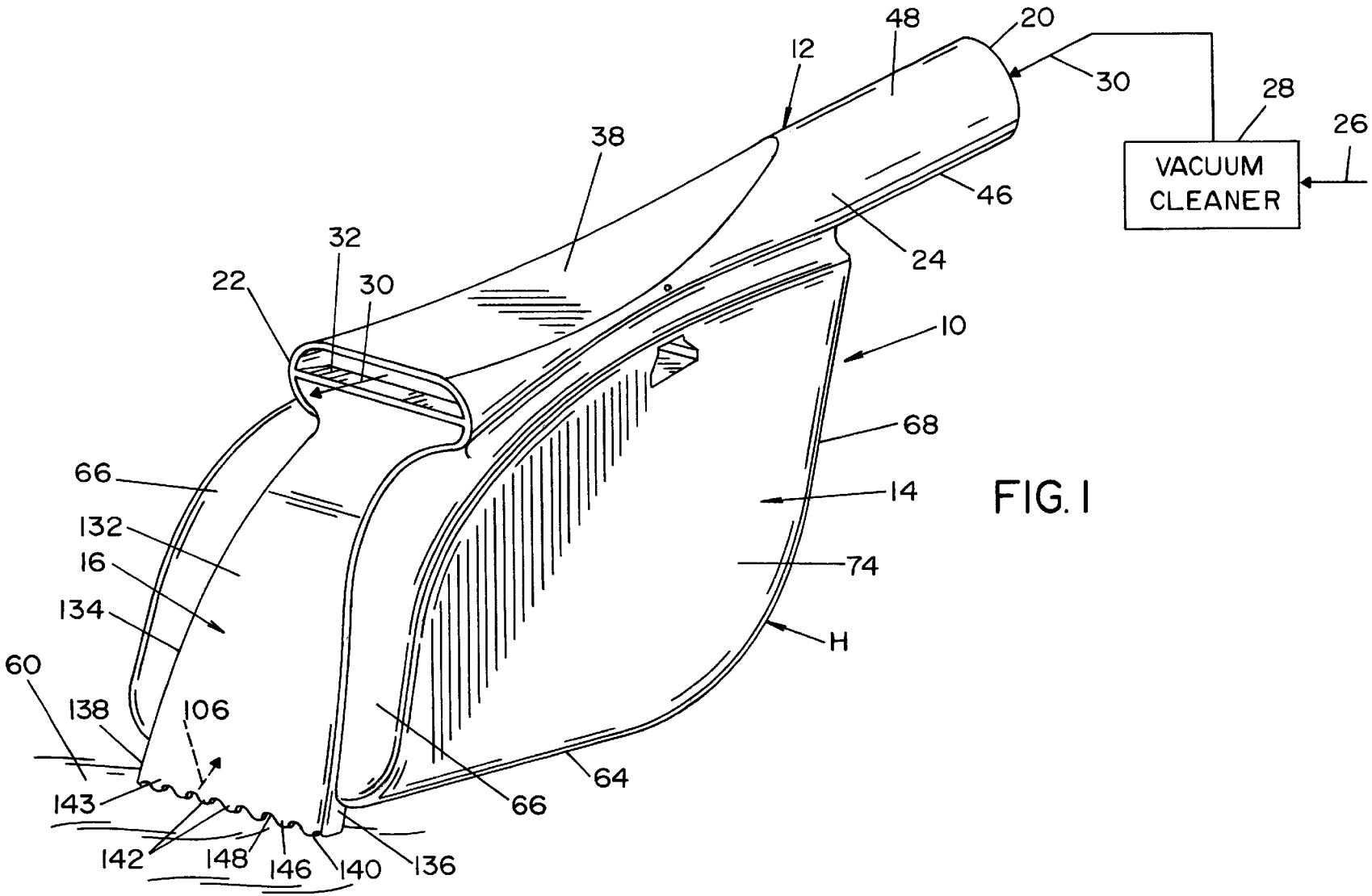
FIG. 1 is a perspective view of a vacuum cleaner attachment in accordance with the present invention.
Figure 2:
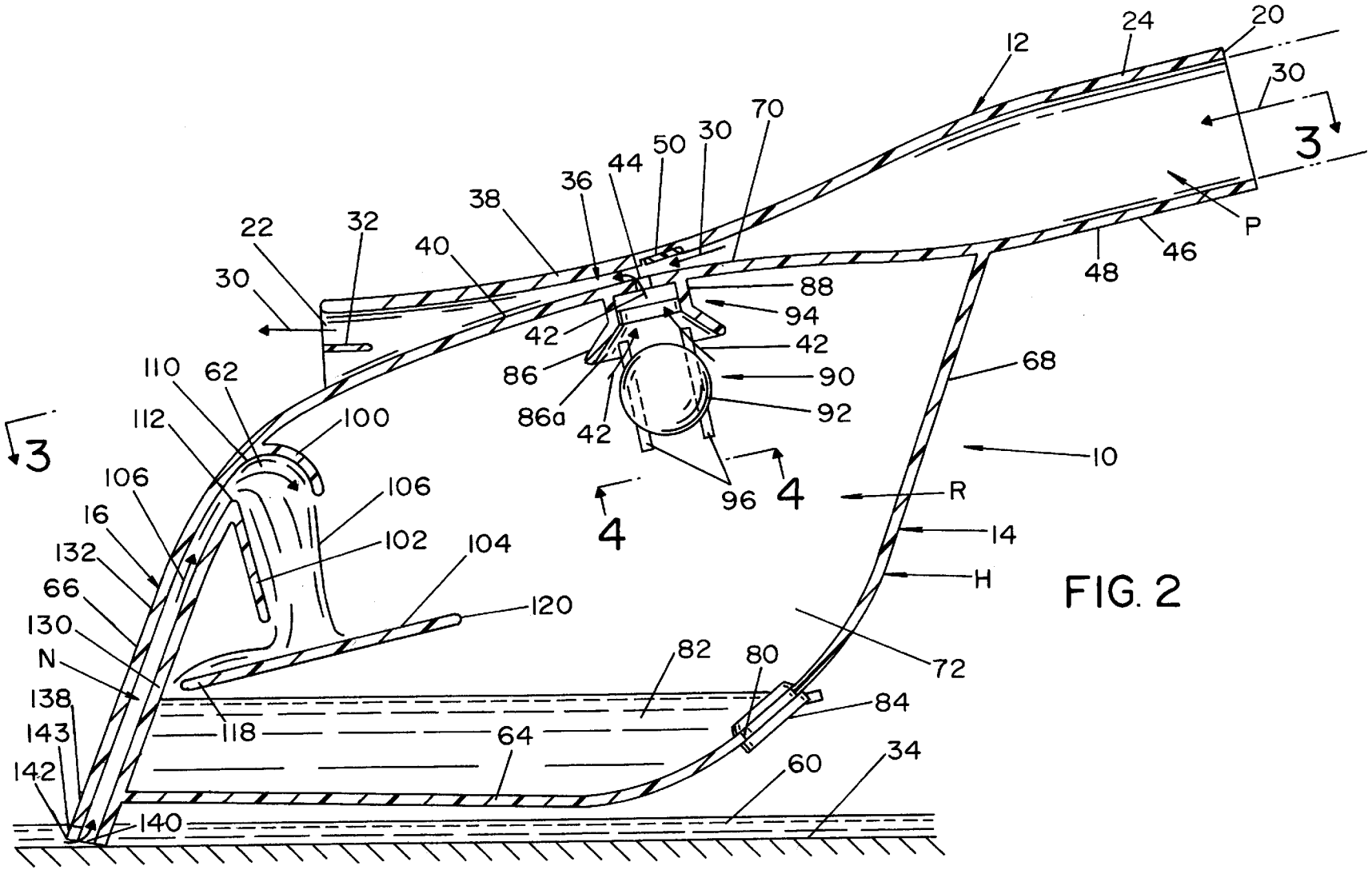
FIG. 2 is a sectional side elevation view of the attachment shown in FIG. 1 and showing a ball valve compartment thereof open.
Figure 3:
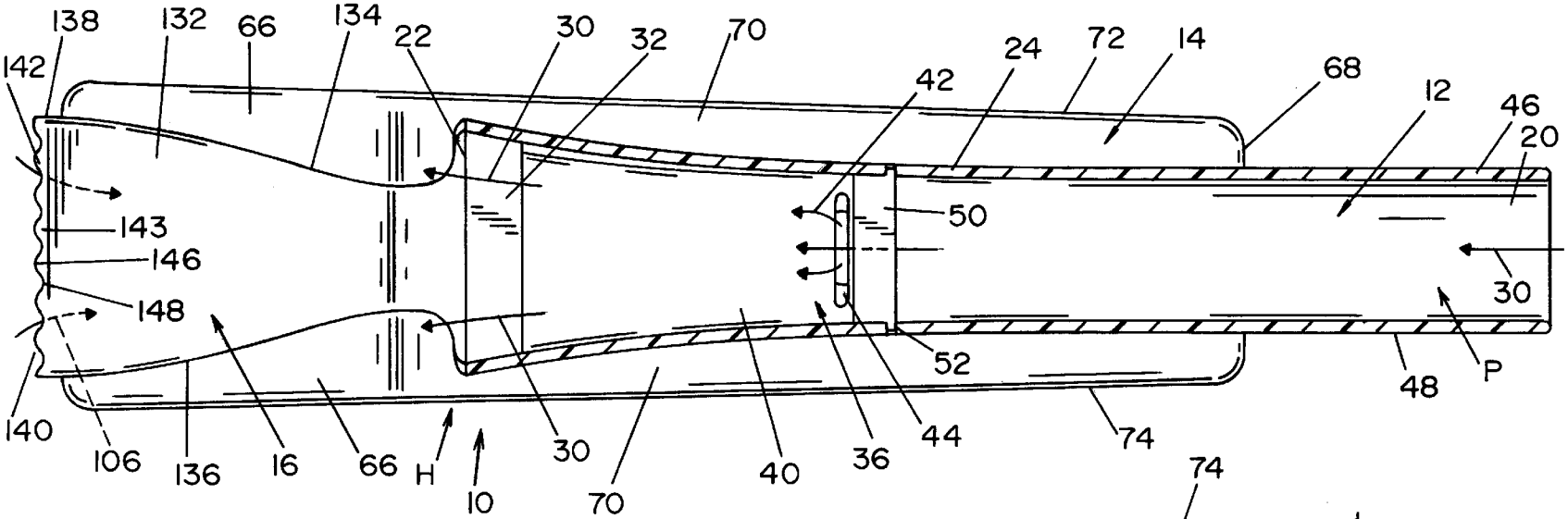
FIG. 3 is a sectional top plan view taken along line 3—3 in FIG. 2.
Figure 4:
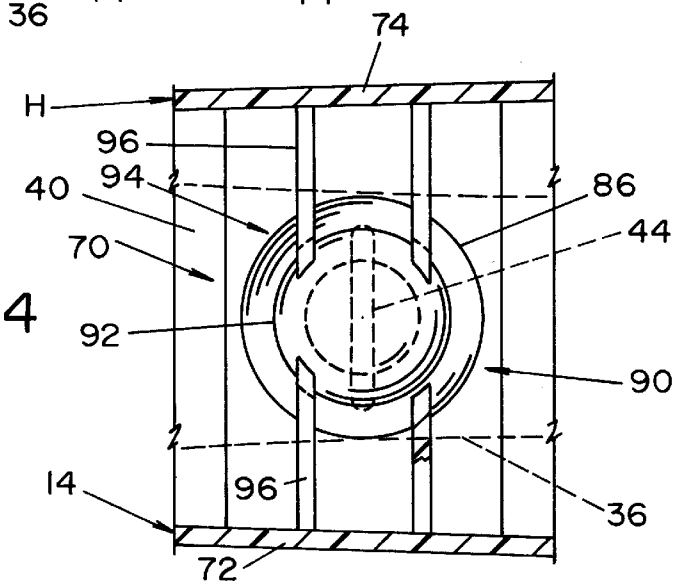
FIG. 4 is an enlarged partial sectional bottom plan view taken along line 4—4 in FIG. 2.

Referring now in greater detail to the drawings wherein the showings are for the purpose of illustrating the preferred embodiments of the invention only and not for the purpose of limiting the invention, FIGS. 1–7 illustrate a first embodiment of a vacuum cleaner attachment 10 comprising a housing H having a tubular portion 12 providing an elongated passageway P, a receptacle portion 14 providing a reservoir R and a nozzle portion 16 providing an intake passageway N.

Tubular portion 12 is essentially an elongated tubular member having a first end 20 and a second end 22 with an outer peripheral wall 24 extending between the first and second ends 20 and 22 respectively. Preferably, first end 20 is adapted to receive the exhaust air flow 30 of vacuum cleaner 28 having a vacuum intake 26, and second end 22 is adapted to discharge the exhaust exiting elongated passageway P. First end 20 includes a cross-sectional configuration which allows it to be connected, for example, in a fluid connection with the attachment hose of vacuum cleaner 28. It should be noted that vacuum clearer attachment 10 can be used in connection with virtually any vacuum cleaner which has or can be provided with an exhaust attachment feature. Further, vacuum cleaner attachment 10 could be connected to the intake of the vacuum cleaner. Nonetheless, vacuum cleaner attachment 10 will be described according to its use in connection with a traditional hose assembly with a cylindrical cross-sectional configuration attached to the exhaust of the vacuum cleaner. First end 20 is in fluid connection with second end 22 such that air flow 30 produced by vacuum cleaner 28 flows through passageway P from first end 20 to second end 22, and end 22 includes an air deflector 32 to direct the exhausted air 30 upwardly away from an underlying surface 34 on which the attachment is to be used.

Between first end 20 and second end 22, passageway P includes a venturior restricted passage portion 36 wherein the cross-sectional area of the passageway P is less than cross-sectional area of first end 20 which is the inlet for the passageway. Shown are longitudinally extending arcuate top and bottom walls 38 and 40 which are curved toward one another to form restricted passage portion 36; however, other portions of peripheral wall 24 could be utilized to produce a restricted passage portion. The restricted passage portion 36 in passageway P causes air flow 30 to increase in velocity on the downstream side of the restriction resulting in a drop in pressure in the restricted passage portion 36. The pressure drop produces a vacuum in reservoir R which, as shown by arrows 42, is drawn into passageway P through an opening 44 in wall 40 which connects reservoir R to passageway P. Housing portion 12 can provide a handle portion 46 at its first end 20 extending rearwardly beyond housing portion 14 to provide a gripping point for the user. Handle portion 46 can include on its outer surface 48 a comfort grip configuration, which is not shown, shaped to receive the user's hand.

Figure 6:
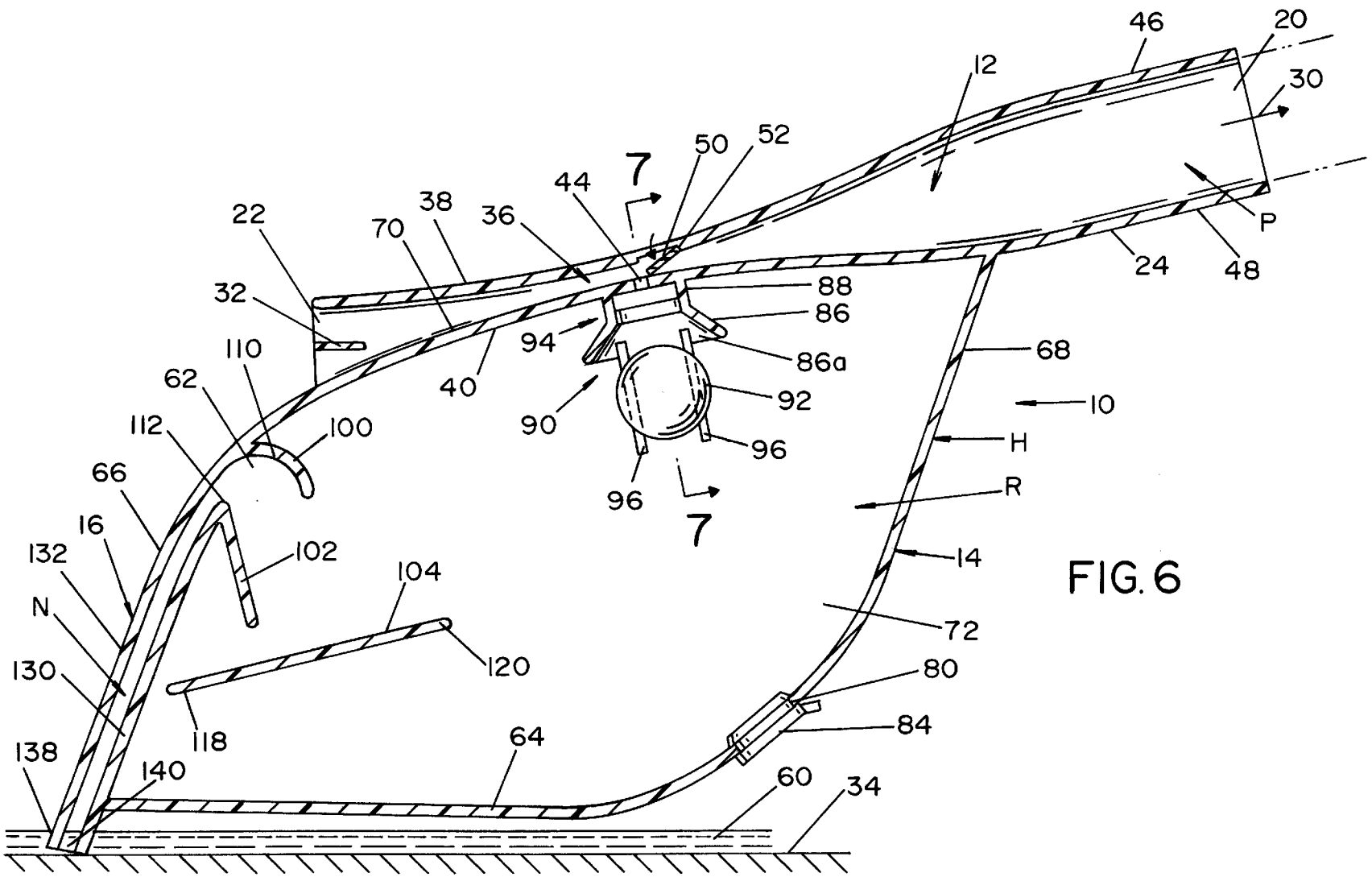
FIG. 6 is a sectional side elevation view similar to FIG. 2 wherein the air flow has been reversed.

Referring to FIGS. 5–7, passageway P can further include a one way valve in the form of a flap 50 to prevent moisture from entering vacuum cleaner 28. In this respect, air flow 30 in vacuum cleaner attachment 10 is generated by the exhaust of the vacuum cleaner 28 and, therefore, any moisture entering air flow 30 from reservoir R is not able to enter the air stream within vacuum cleaner 28. Instead, any such moisture entering the air flow 30 is exhausted out second end 22.

However, as shown in FIG. 6, if first end 20 is inadvertently connected to the vacuum inlet of K i vacuum cleaner 28, air flow in passageway P is reversed and would could enter vacuum 28 and, possibly, would include moisture from liquid reservoir R. Flap 50 prevents this by inhibiting the formation of a vacuum in reservoir R if air flow is reversed so as to flow through passageway P from second end 22 toward first end 20. More particularly, flap 50 is pivotally supported on top wall 38 of passageway P at its top edge 52 and therefore pivots downwardly to a closed position about its top edge 52 by its own weight. Referring to FIG. 5, air flow 30 moving from first end 20 toward second end 22 forces flap 50 to pivot upwardly about top edge 52 to an open position. Conversely, air flow from second end 22 toward first end 20 will not open flap 50 thereby stopping the air flow ahead of opening 44 and preventing a vacuum in the reservoir.

Reservoir R is configured to retain a liquid 60 removed from floor surface 34 through intake passageway N of nozzle 16 and which liquid enters reservoir R through nozzle exit opening 62 which will be discussed in greater detail below. Reservoir R includes a bottom wall 64, a front wall 66, a rear wall 68, a top wall 70 which is defined in part by arcuate wall 40 of restricted passageway 36, reservoir R further includes a drain 80 to allow the collected liquid 82 to be discarded. Drain 80 is selectively sealable by a drain plug 84.

A ball valve 90 is incorporated into the reservoir top wall 70 to seal off opening 44 under an overfilled condition or an inverted condition of the attachment. Such closing of opening 44 helps prevent the collected liquid 82 from entering passageway P and being transported out second end 22 by air flow 30 if the attachment is in operation, or by gravity if it is not. In this respect, ball valve 90 includes a ball float 92, a ball seat 94 and ball float retainers 96. Ball seat 94 surrounds opening 44 and includes a skirt 86 and a connecting tube 88 extending between skirt 86 and wall 40. Skirt 86 is shaped to receive ball float 92 such that when ball float 92 is urged against inner surface 86*a* of skirt 86, opening 44 is sealed thereby precluding a vacuum being created in reservoir R and inhibiting the collected liquid 82 from passing through opening 44 into passageway P. Ball float 92 is retained in an operating position adjacent to ball seat 94 by ball retainers 96 having curved lower ends 98 to maintain ball support in the open position and essentially straight upper portions 99 which guide ball float 92 into a closed position wherein it sealingly engages surface 86*a*. With respect to the over filled condition, when the collected liquid 82 becomes too high within reservoir R, ball float 92 is urged upwardly by collected liquid 82 and engages surface 86*a* of ball seat 94 which seals opening 44 and prevents the vacuum from being formed in reservoir R. With respect to an inverted condition, FIG. 5 shows vacuum cleaner attachment 10 on its side with ball valve 90 in the closed position by gravity and/or suction through opening 44 if the attachment is in operation. If vacuum cleaner attachment 10 is totally inverted, the weight of ball float 92 urges ball float 92 against surface 86*a* of ball seat 94. However, if vacuum cleaner attachment 10 is on its side, as shown in FIG. 5, the float's weight alone may not propel the ball toward ball seat 94. In this case, curved edges 98 help propel ball float 92 from a retained position against lower ends 98 toward ball seat 94 to facilitate the closing of opening 44.

In order to minimize the amount of liquid entering air stream 30 and therefore exiting second opening 22, reservoir R includes first and second deflectors 100 and 102 respectively and deflector plate 104, all three of which work in connection with intake nozzle 16 to control the fluid stream 106 as it enters reservoir R. Further, deflectors 100, 102 and 104 help to separate the liquid 60 from the air in the fluid stream 106 and maintain the contained liquid 82 at the bottom of reservoir R. More particularly, fluid stream 106 enters reservoir R through nozzle exit opening 62 which has a top edge 110, and a bottom edge 112. First deflector 100 is arcuate and defines top edge 110 and is downwardly curved toward reservoir bottom wall 64. First deflector 1 00 diverts the fluid stream 106 entering through the nozzle exit opening 62 downwardly away from opening 44. Second deflector 102 has an upper end adjacent nozzle opening bottom edge 112 and extends downwardly in the reservoir so as to work in connection with first deflector 100 to direct the fluid stream 106 downwardly toward reservoir bottom wall 64. Deflector plate 104 is spaced below the lower ends of first and second deflectors 100 and 102 is spaced above reservoir bottom wall 64 and extends forwardly and rearwardly of the lower ends of deflectors 100 and 102. Accordingly the fluid stream 106 is directed by deflectors 100 and 102 downwardly against deflector plate 104. Deflector plate 104 further directs the fluid stream away from opening 44 by being tilted downwardly toward reservoir front wall 66. In this respect, deflector plate 104 has a front edge 118 and a rear edge 120 and front edge 118 is lower than rear edge 120.

Intake nozzle 16 is a part of front wall 66 of reservoir R and includes a rear or inner wall 130 having an upper end blending with deflector 102 to provide bottom edge 112 of the nozzle opening. Nozzle 16 further includes a front wall 132 opposite rear wall 130 and nozzle side walls 134 and 136 which join rear wall 130 to front wall 132. Intake nozzle 16 further includes an extension 138 below bottom wall 64 of the reservoir and having a nozzle inlet opening 140 at its lower end. By extending below reservoir bottom wall 64, nozzle extension 138 allows nozzle opening 140 to contact liquid 60 without bottom wall 64 coming in contact with the liquid. Nozzle inlet opening 140 provides entry for liquid 60 into nozzle 16 as a fluid stream 106, and inlet opening 140 includes a plurality of scallops 142 about a portion of its perimeter to facilitate the removal of liquid 60 from a variety of floor surfaces 34. In this respect, scallops 142 are positioned on the front edge 143 of inlet opening 140 and provide peaks 146 that are separated from adjacent peaks by valleys 148 such that when nozzle opening is positioned on a smooth floor surface liquid 60 can pass through valleys 148. In addition, scallops 142 also act as: agitators when liquid 60 is being removed from a carpeted surface. It is preferred that the scallops are approximately 3/16" in height from valley 148 to peak 146.

While intake nozzle 16 could be any one of many cross-sectional configurations, intake passageway N is generally rectangular cross-sectionally and preferably narrows laterally in the direction from inlet opening 140 to outlet opening 62 to promote the flow of liquid therethrough under the influence of the vacuum in reservoir R.

In the following discussions concerning other embodiments, the components of the vacuum cleaner attachment 10 which remain the same, as discussed above, will include the same reference numbers as above.

Figures 8, 9:
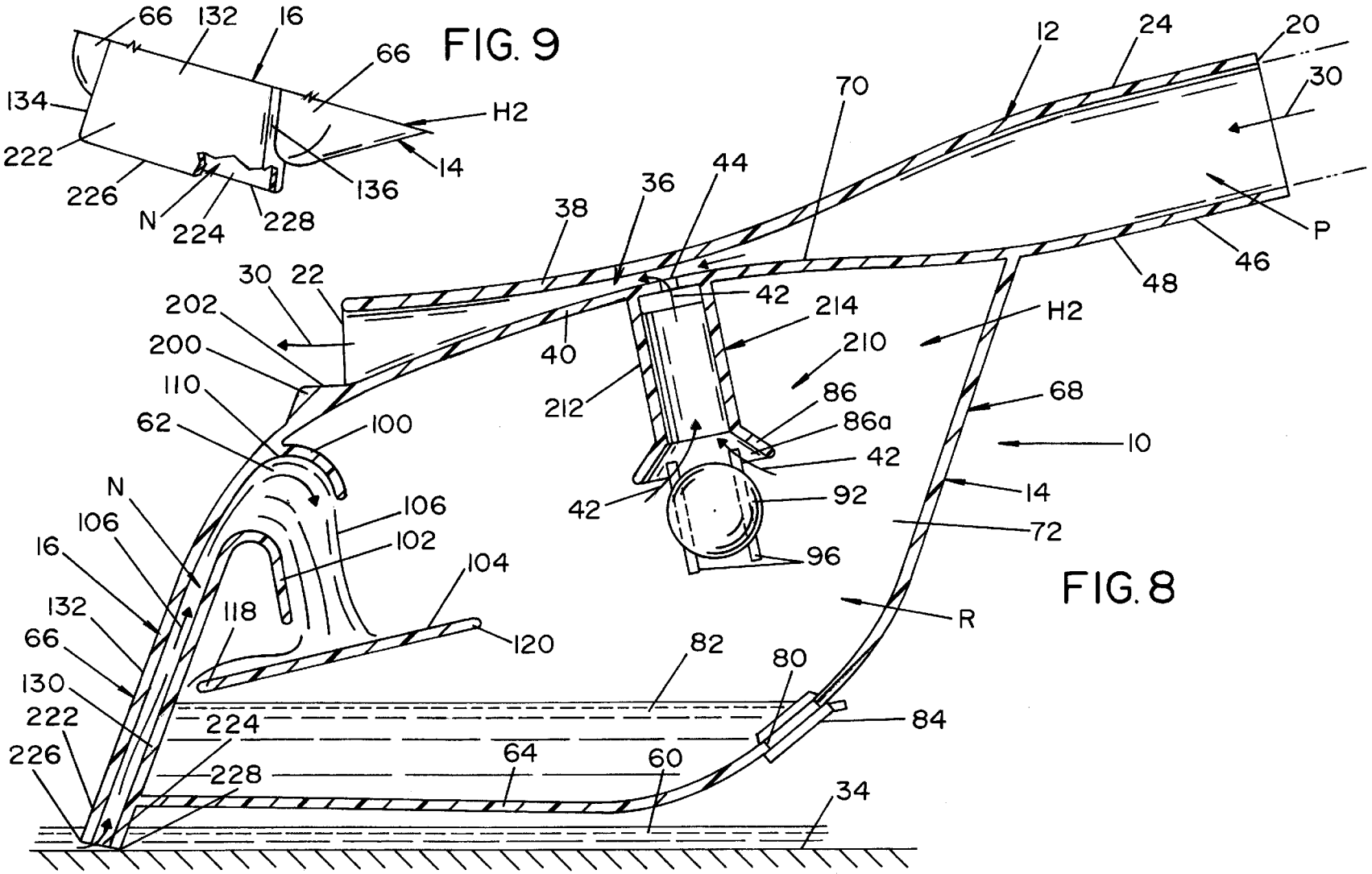
FIG. 8 is a sectional side elevation view of other embodiments of the attachment shown in FIG. 1.
FIG. 9 is a partial pictorial view of the intake nozzle shown in FIG. 8.

Referring to FIGS. 8 and 9, modifications of the embodiment of FIGS. 1–7 are shown. While the modifications of the vacuum cleaner attachment 10 are shown together in FIGS. 8 and 9, it should be noted that any one or any combination of the modifications shown in FIGS. 8 and 9 could be utilized in vacuum cleaner attachment 10.

Housing H2 is essentially the same as housing H shown in FIGS. 1–7 with a tubular portion 12 providing an elongated passageway P, a receptacle portion 14 providing a reservoir R and a nozzle portion 16 providing an intake passageway N. However, housing H2 includes air deflector 200 to direct the exhausted air 30 upwardly away from the underlying surface 34. Air deflector 200 is positioned on the lower side of second end 22 of tubular portion 12 and includes an upwardly facing surface 202 which is molded into housing H2 and which directs the exhausted air 30 upwardly as it exits passageway P.

Housing H2 further includes ball valve 210 which is similar to ball valve 90 described above. Ball valve 210 includes ball float 92, a ball seat 214 and ball float retainers 96. The difference relates to ball seat 214 which surrounds opening 44 and includes skirt 86 providing inner sealing surface 86*a*. In this respect, ball seat 214 includes extended connecting tube 212 which lowers the shut off point of ball valve 210 in reservoir R thereby allowing less liquid to be retained within reservoir R. Lowering the shut off point further reduces the possibility of the fluid exiting opening 44 and entering into airflow 30. In general, ball valve 210 illustrates that the amount of fluid that is allowed to be retained in reservoir R can be controlled by the length of the connecting tube.

Intake nozzle 16 includes a modified nozzle extension 222 having an inlet opening 224 with a front edge 226 and a rear edge 228 which are both essentially flat. In addition, one or both of edges 226 and 228 could be made from a soft elastic type material, not shown, different from that of the housing to further help direct the fluid into nozzle inlet opening 224.

Referring to passageway P, flap 50 shown in FIGS. 5–7, has been removed. By removing flap 50, vacuum cleaner attachment 10 can be used on both the inlet and the exhaust of the vacuum cleaner 28.

While considerable emphasis has been placed herein on the specific structure and structural relationships between the component parts of the preferred embodiment of the invention, it will be appreciated that other embodiments can be made and that many changes can be made in the preferred embodiment without departing from the principals of the invention. Accordingly, it is to be distinctly understood that the foregoing descriptive matter is to be interpreted merely as illustrative of the present invention and not as a limitation.

Having thus described the invention, it is claimed:

1. A vacuum cleaner attachment for converting a dry vacuum cleaner into a wet vacuum cleaner comprising: a housing including a passage having a first end and a second end in fluid connection with said first end, said housing including means for coupling said first end with one of the outlet and inlet of a vacuum cleaner for providing an air stream through said passage from said first end toward said second end, a reservoir in said housing having an intake nozzle, and a restricted passageway portion in said passage between said first and second ends and having an opening in fluid communication with said reservoir such that when the air stream passes through said passage said restricted passageway portion produces a vacuum in said reservoir thereby drawing liquid from a surface into said reservoir through said intake nozzle of said reservoir.

2. The vacuum cleaner attachment according to claim 1, wherein said reservoir has a reservoir bottom wall and a generally opposing reservoir top wall, reservoir front and rear walls joining said reservoir top and bottom walls, and said passage being juxtaposed said reservoir top wall, and said opening being in said reservoir top wall.

3. The vacuum cleaner attachment according to claim 2, wherein said passage includes a passage top wall and a passage bottom wall and said passage bottom wall is in part formed by said reservoir top wall.

4. The vacuum cleaner attachment according to claim 3, wherein said passage top wall includes an arcuate wall portion forming part of said restricted passageway portion.

5. The vacuum cleaner attachment according to claim 4, wherein said reservoir top wall includes an arcuate wall portion forming part of said restricted passageway portion.

6. The vacuum cleaner attachment according to claim 1, wherein said reservoir has a reservoir bottom wall and a generally opposing reservoir top wall, and reservoir front and rear walls joining said reservoir top and bottom walls, said reservoir further including a nozzle wall inwardly of said reservoir front wall, said housing further including a nozzle passage in fluid connection between said intake nozzle and said reservoir, said nozzle passage is in part formed by said nozzle wall.

7. The vacuum cleaner attachment according to claim 6, wherein said nozzle passage includes an outlet spaced above said reservoir bottom wall.

8. The vacuum cleaner attachment according to claim 7, wherein said intake nozzle includes an inlet below said reservoir bottom wall.

9. The vacuum cleaner attachment according to claim 1, wherein said housing further includes an elongated tubular member providing said passage and having an outer peripheral wall extending between said first and second ends of said passage, and a portion of said peripheral wall forming a portion of said reservoir.

10. The vacuum cleaner attachment according to claim 9, wherein said restricted passageway portion is at least partially formed by said peripheral wall portion.

11. The vacuum cleaner attachment according to claim 10, wherein said reservoir, said tubular member and said intake nozzle are a unitary component.

12. The vacuum cleaner attachment according to claim 1, wherein said housing further includes an elongated tubular member providing said passage and having an outer peripheral wall, a portion of said elongated tubular member forming said restricted passageway portion and including a venturi contour in said outer peripheral wall.

13. The vacuum cleaner attachment according to claim 1, wherein said reservoir has a reservoir bottom wall and a generally opposing reservoir top wall, and reservoir front and rear walls joining said reservoir top and bottom walls, a portion of said passage being juxtaposed said reservoir top wall, and said first end of said passage extending rearwardly beyond said reservoir rear wall.

14. The vacuum cleaner attachment according to claim 13, wherein said first end of said passage extends beyond said rear wall less than 6 inches.

15. The vacuum cleaner attachment according to claim 1, further including a ball valve in said reservoir for selectively sealing said opening.

16. The vacuum cleaner attachment according to claim 15, wherein said reservoir has a reservoir bottom wall and a generally opposing reservoir top wall, and reservoir front and rear walls joining said reservoir top and bottom walls, said opening being in said reservoir top wall, said ball valve comprising a ball seat in said reservoir top wall about said opening and a ball float retained in said reservoir adjacent to said ball seat by a plurality of ball retainers.

17. The vacuum cleaner attachment according to claim 1, wherein said reservoir has a reservoir bottom wall and a generally opposing reservoir top wall, and reservoir front and rear walls joining said reservoir top and bottom walls, said intake nozzle being juxtaposed said reservoir front wall, said reservoir front wall including a nozzle outlet opening for passage of the liquid from said intake nozzle into said reservoir.

18. The vacuum cleaner attachment according to claim 17, wherein said nozzle outlet opening includes a deflector for controlling the direction of the liquid entering said reservoir.

19. The vacuum cleaner attachment according to claim 18, wherein said nozzle outlet opening has a top edge and said deflector includes a first downwardly curved deflector member above said top edge and having a lower end adjacent said top edge of said nozzle outlet opening.

20. The vacuum cleaner attachment according to claim 19, wherein said nozzle outlet opening further includes a bottom edge and said deflector further includes a second deflector member extending downwardly from said bottom edge of said nozzle outlet opening.

21. The vacuum cleaner attachment according to claim 20, wherein said second deflector member has a lower end spaced below said lower end of said first downwardly curved deflector member, and a deflector plate in said reservoir beneath said lower end of said second deflector member.

22. The vacuum cleaner attachment according to claim 21, wherein said deflector plate has a front edge adjacent said front wall of said reservoir and a rear edge spaced from said front edge, and said deflector plate being angled downwardly from said rear edge toward said front edge.

23. The vacuum cleaner attachment according to claim 1, further including a one way valve in said passage to prevent the air stream from passing through said passage from said second end toward said first end.

24. The vacuum cleaner attachment according to claim 23, wherein said passage has a top wall and said one way valve is a flapper valve connected to said passage top wall.

25. The vacuum cleaner attachment according to claim 1, wherein said housing further includes an air deflector at said passage second end, said air deflector directing said stream upwardly as it exits said passage.

26. The vacuum cleaner attachment according to claim 1, wherein said intake nozzle has a nozzle opening through which the liquid is drawn from the surface into said reservoir, said nozzle opening including a plurality of scallops.

27. The vacuum cleaner attachment according to claim 26, wherein said nozzle opening has a front edge and a rear edge and said plurality of scallops are positioned on only one of said front and rear edges.

28. The vacuum cleaner attachment according to claim 26, wherein said nozzle opening has a front edge and a rear edge and said plurality of scallops are positioned on said front edge only.

29. A vacuum cleaner attachment which can be connected to an outlet of a vacuum cleaner having a vacuum source for drawing a vacuum through an inlet of the vacuum cleaner and exhausting the same through the outlet, said attachment converting a dry vacuum cleaner into a wet vacuum cleaner such that a liquid can be removed from a surface, said attachment comprising: a housing including an elongated passage having a first end, a second end in fluid connection with said first end, an outer peripheral wall extending between said first and second ends, means for coupling said first end with the outlet of the vacuum cleaner so that the air stream produced by the vacuum source is passed through said passage from said first end toward said second end, said peripheral wall including a constricted portion forming a restricted passageway portion in said passage between said first and second ends; a reservoir in said housing having an opening in fluid connection with said restricted passageway portion such that when the air stream passes through said passage said restricted passageway portion produces a vacuum in said reservoir; and an intake nozzle in fluid connection with said reservoir such that the vacuum in said reservoir draws liquid from a surface into said reservoir through said intake nozzle.

* * * * *